US006086278A

United States Patent [19]

Keller

[11] Patent Number: 6,086,278

[45] Date of Patent: Jul. 11, 2000

[54] FOAM DISPENSING BOTTLE BRUSH

[76] Inventor: James McNeel Keller, 129 Cedar St., San Antonio, Tex. 78210

[21] Appl. No.: 08/229,951

[22] Filed: Apr. 19, 1994

[51] Int. Cl.[7] ..... B43M 11/06

[52] U.S. Cl. ..... 401/183; 401/186; 401/270; 401/274

[58] Field of Search ..... 401/183, 186, 401/268, 270, 274, 276, 282, 286, 288, 291; 222/211, 464, 145.5, 145.1, 206, 402.18, 402.19; 210/514; 239/327

[56] References Cited

U.S. PATENT DOCUMENTS

| | | | |
|---|---|---|---|
| D. 165,109 | 11/1951 | Petrosky | 401/288 X |
| D. 333,920 | 3/1993 | Vetter | D4/114 |
| 2,617,431 | 11/1952 | Gaspari | 401/291 X |
| 2,653,848 | 9/1953 | Lee | 222/190 |
| 2,726,417 | 12/1955 | Rowser et al. | 401/183 |
| 2,729,505 | 1/1956 | Harvey | 401/186 |
| 2,750,615 | 6/1956 | Brazeman | 401/183 |
| 2,793,794 | 5/1957 | Samuel | 222/402.19 |
| 2,820,234 | 1/1958 | Rigney | 401/186 |
| 2,924,360 | 2/1960 | Samuel | 222/402.19 |
| 3,015,836 | 1/1962 | Maynier et al. | 401/186 |
| 3,018,023 | 1/1962 | Talarico | 222/402.19 |
| 3,149,758 | 9/1964 | Bush et al. | 222/211 X |
| 3,170,633 | 2/1965 | Castelli | 239/327 |
| 3,178,081 | 4/1965 | Adams | 222/211 X |
| 3,260,421 | 7/1966 | Rabassier | 222/402.18 |
| 3,471,064 | 10/1969 | Micallef | 222/211 |
| 3,485,563 | 12/1969 | Chennell | 401/183 |
| 3,547,296 | 12/1970 | Greenberg | 222/464 X |
| 3,951,314 | 4/1976 | Toro | 222/402.18 X |
| 4,836,422 | 6/1989 | Rosenberg | 222/211 X |
| 4,928,857 | 5/1990 | Ecker | 222/211 |
| 5,143,288 | 9/1992 | Kohler et al. | 222/402.18 X |

FOREIGN PATENT DOCUMENTS

| | | | |
|---|---|---|---|
| 208513 | 9/1959 | Austria | 222/211 |
| 523963 | 11/1953 | Belgium | 222/211 |
| 1243684 | 9/1960 | France | 401/183 |
| 1048202 | 12/1958 | Germany | 401/183 |
| 2206247 | 8/1973 | Germany | 401/183 |
| 3529712 | 10/1986 | Germany | 401/186 |
| 2812 | of 1914 | United Kingdom | 401/282 |
| 2812 | 2/1914 | United Kingdom | 401/184 |
| 815644 | 7/1959 | United Kingdom | 222/402.19 |
| 870164 | 10/1959 | United Kingdom | 401/288 |
| 1311086 | 3/1973 | United Kingdom | 222/211 |

*Primary Examiner*—David J. Walczak
*Attorney, Agent, or Firm*—Albert Peter Durigon

[57] ABSTRACT

An improved bottle brush includes a brush, a squeeze bottle having an internal cavity and a feed tube of predetermined configuration extending from the brush into the internal cavity of the bottle. A liquid cleaning agent partially fills the internal cavity and partitions it into a region of liquid and a superadjacent region of foam. The foam is produced initially by shaking the bottle and is maintained automatically by the shaking action of scrubbing. The bottle brush is usable in a foam-feed and a liquid-feed mode, and the predetermined configuration of the feed tube is determined such that it opens into the region of foam when used in the foam-feed mode and opens into a region of liquid when used in the liquid-feed mode. In either mode, foam or liquid respectively is controllably dispensed without wastage of the liquid cleaning agent by gently squeezing the bottle. A conversion element is disclosed for converting a conventional liquid-feed bottle brush into one that feeds liquid and foam in accord with the present invention.

17 Claims, 3 Drawing Sheets

FOAM DISPENSING BOTTLE BRUSH

FIELD OF THE INVENTION

This invention is drawn to the field of containers, and, more particularly, to an improved bottle brush.

BACKGROUND OF THE INVENTION

Among the devices commonly used to clean dirty dishes, pots and the like belongs the so-called bottle brush. Such a device has the advantage that it includes an interior reservoir of liquid soap which may be dispensed directly from the bottle to the brush (or other scrubbing head) as the soap is consumed during the cleaning process.

In the heretofore known bottle brushes, the dispensation of the liquid soap has been effected either continuously or intermittently. One known continuous dispensation technique was to provide liquid soap in a tube that opened at such an angle to a sponge that the soap was fed to the sponge by gravitational action. However, not only was the tube/sponge interface fragile but the liquid soap itself tended to seep out through the sponge and thereby was continually being wasted.

One known intermittent liquid dispensation control technique was to provide a flow restriction in a liquid soap feed orifice that opened between a brush and a reservoir of liquid soap contained within a squeeze bottle. The flow restriction occluded flow of liquid soap to the brush unless and until a powerful squeeze was imparted to the squeeze bottle. However, the flow restriction tended to clog up, either partially or completely, which adversely impacted the utility of the device, and it was difficult to clean out once it had become clogged. Moreover, liquid soap tended to leak out through the flow restriction due to gravitational action, and it was pumped out inadvertently, due to changing the grip on the squeeze bottle, which wasted the liquid soap.

Another known intermittent liquid soap dispensation control technique was to provide a hand-actuated mechanism, such as a spring-loaded slide valve, in a liquid soap feed orifice that opened between a brush and a reservoir of liquid soap contained within a squeeze bottle. While this technique achieved a good control of liquid soap dispensation, it was disadvantageous in that its mechanical complexity rendered it expensive to manufacture and difficult to maintain and repair.

SUMMARY OF THE INVENTION

It is accordingly one principal object of the present invention to provide an improved bottle brush that overcomes the disadvantages of the heretofore known bottle brushes. In accord therewith, an improved bottle brush is disclosed that is simple to manufacture and maintain, that is substantially free from clogs and that enables to intermittently dispense a controlled measure of foam and/or a controlled measure of liquid in a manner that substantially eliminates wastage of liquid cleaning agent.

The improved bottle brush of the present invention includes a liquid and/or foam applicator and scrubber head having a feed orifice; a squeeze bottle having a body of flexible walls and a base, that enclose an internal cavity, and an-open mouthed neck, to which the applicator and scrubber head is releasably mounted with its orifice in alignment with the open mouth thereof; and a feed tube having a supply and a feed end that is mounted in the bottle with its feed end in sealing relation with the orifice of the applicator head and with its supply end opening into the internal cavity of the squeeze bottle. A liquid cleaning agent, such as one part liquid soap diluted with ten parts water, is disposed in the cavity to partially fill and so to partition the same into a region of liquid and a superadjacent region where foam may be produced by shaking the bottle. The squeeze bottles internal cavity is compressible by squeezing the flexible walls of the bottle, whereby the regions of foam and liquid are concomitantly compressed.

The improved bottle brush of the present invention is used in one of two modes. In a foam dispensing and use mode, the squeeze bottle is seized by the hand and maintained and manipulated in a first orientation, preferably a generally horizontal orientation, to impart a scrubbing action to the applicator head mounted to its neck. In a liquid dispensing mode, the squeeze bottle is seized by the hand and maintained in a second orientation, preferably at an angle where the applicator head is upended from its position in the first orientation, to ready the applicator head for a dispensation of liquid cleaning agent. The disclosed feed tube has a predetermined configuration determined in relation to the first and second orientations of the squeeze bottle such that its supply end opens into a region of foam when the bottle is being used in its use and foam dispensing mode and such that its supply end opens to a region of liquid when the squeeze bottle is being used in its liquid dispensing mode. In the preferred embodiment, the feed tube is bent such that its supply end opens at a point at and near both the base and the wall portions of the squeeze bottle.

In either mode, foam or liquid is applied to the applicator head by gently squeezing the squeeze bottle. In this manner, since only a controlled amount of foam or liquid is intermittently dispensed, there is little or no waste of the liquid cleaning agent, and because the feed tube is itself preferably of a comparatively-large and uniform diameter, it always remains open and free from clogs. The pumping of foam imparts very little resistance. Since only soap foam, but not liquid, can be dispensed in the foam feed mode, any foam that may be inadvertently dispensed by changing the grip in normal use contains only a tiny fraction of liquid and thereby wastes only an insignificant amount of already dilute liquid cleaning agent.

It is another object of the present invention to provide an apparatus for use with a conventional bottle brush for converting the same into an improved bottle brush in accord with the present invention. In accord therewith, a conversion element comprising a feed tube of predetermined configuration having a feed and a supply end and a sealing member disposed about the feed end thereof is disclosed. The conversion element is received within the bottle of the bottle brush to be converted with the sealing member thereof in sealing relation to the brush feed orifice of the brush (or other applicator head) of the bottle brush to be converted and with the feed tube thereof extending into the internal cavity of the bottle of the bottle brush to be converted. The predetermined configuration of the feed tube thereof is determined in relation to the orientations of the brush bottle to be converted that correspond to its foam and liquid feed modes such that its supply end would extend respectively into a region of foam and into a region of liquid of the internal cavity of the brush bottle to be converted should the same be used in the corresponding one of those modes.

BRIEF DESCRIPTION OF THE DRAWINGS

These and other objects and advantages of the present invention should become apparent as the invention becomes better understood by referring to the following detailed description of the preferred embodiments, and to the drawings, wherein.

DETAILED DESCRIPTION OF THE PREFERRED EMBODIMENTS

Figure 1:
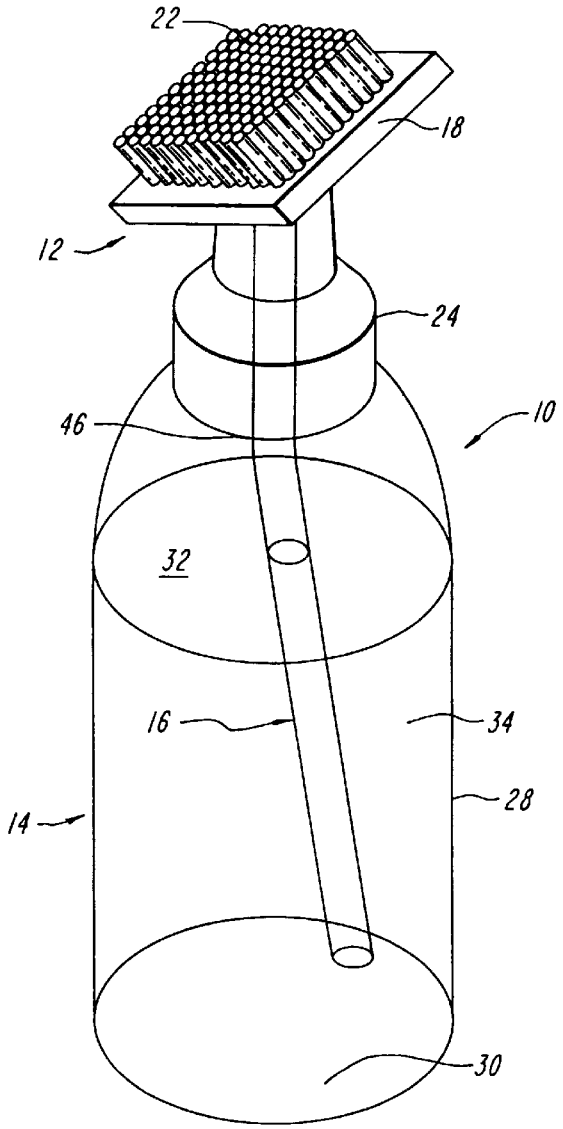
FIG. 1 is a perspective view of an improved bottle brush in accord with the present invention.

Referring now to FIG. 1, generally designated at 10 is a perspective view of an improved bottle brush in accord with the present invention. The bottle brush 10 includes an applicator and scrubbing head generally designated at 12, a squeeze bottle generally designated 14 to which the head 12 is releasably mounted and a feed tube generally designated at 16 having a predetermined configuration to be described mounted into the bottle 14.

Figure 2:
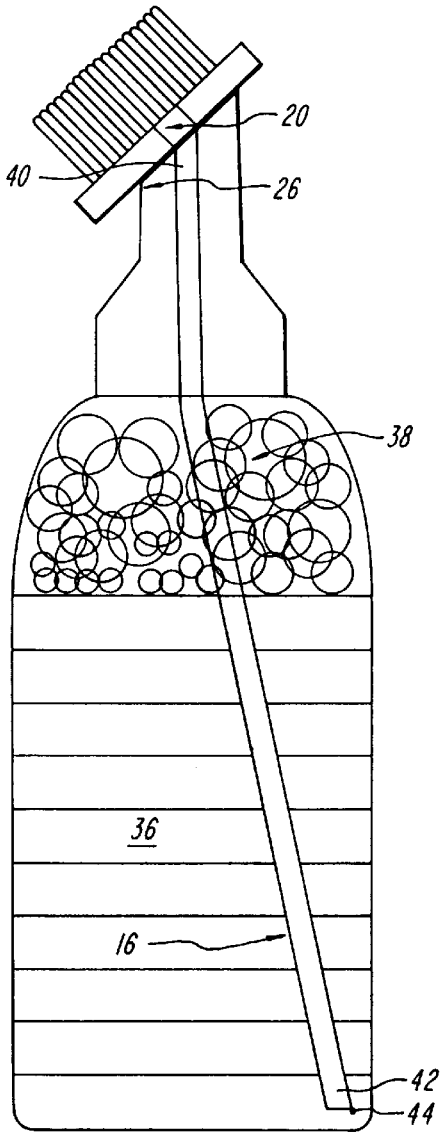
FIG. 2 is a longitudinal sectional view of the improved bottle brush in accord with the present invention that illustrates the same in its fully upended orientation.

The applicator and scrubbing head includes a bristle supporting base member 18 having a feed orifice generally designated 20 thereinthrough best seen in FIG. 2 and a plurality of bristles 22 mounted to the support base symmetrically about the feed orifice 20 thereof. Although bristles 22 are presently preferred, the applicator and scrubbing head 12 may be embodied with a sponge or other applicator and scrubbing element without departing from the inventive concepts.

The squeeze bottle 14 preferably includes a neck portion 24 having an open mouth generally designated at 26 best seen in FIG. 2, a body portion 28 of flexible walls, such as rubber or plastic, and a base portion 30. The body portion 28 is sized to be readily seizable by a human hand and the neck, body and base portions 24,28,30 enclose an internal cavity generally designated 32 whose volume is compressible when the squeeze bottle is seized by a human hand and squeezed thereby.

A liquid cleaning agent 34, such as one part liquid soap diluted with ten parts water, is provided in the cavity 32 in an amount selected to partially fill the same. The liquid cleaning agent 34 partitions the cavity 32 into a region of liquid generally designated at 36 and a region of foam generally designated at 38 as best seen in FIG. 2. The foam is produced by shaking the squeeze bottle, either initially or while the squeeze bottle is being used in a manner to be described. Any proportion of dilution suitable to produce foam may be employed. It may be noted that while the shape of the foam and liquid regions 38,36 of the cavity 32 varies in dependence on the orientation of the bottle 14, the foam region always remains in a relation of superadjacency to the liquid region independently of the orientation of the bottle.

Any suitable means may be employed for releasably mounting the applicator head 12 to the bottle 14. For example, the base 18 of the head 12 may be integrally formed with the neck 24, which may be threadably secured to the bottle 14, or the base 18 may be threadably or otherwise releasably mounted to the open mouth 26 of the neck 24, which is integrally formed with the body portion 28 of the bottle. Any suitable means known to those skilled in the art may be employed so long as the feed orifice of the applicator and scrubbing head is aligned to open into the internal cavity of the squeeze bottle.

The feed tube 16 has a feed end 40 and a supply end 42 both best seen in FIG. 2. The feed end is mounted in sealing relation to the feed orifice 20 of the bristle supporting base 18 of the applicator and scrubbing head 12 and the predetermined configuration of the feed tube is determined such that the supply end opens into the internal cavity 32 of the squeeze bottle 14 at a point marked 44 therein that is adjacent to both the base 30 and the flexible walls 28 of the squeeze bottle 14. In the presently preferred embodiment, the feed tube 16 is bent at 46 as best seen in FIG. 1 such that its supply end 42 is located at the point 44 of the illustrated embodiment although any other configuration that locates the supply end thereof at the point 44 may be employed without departing from the inventive concepts.

Figure 3:
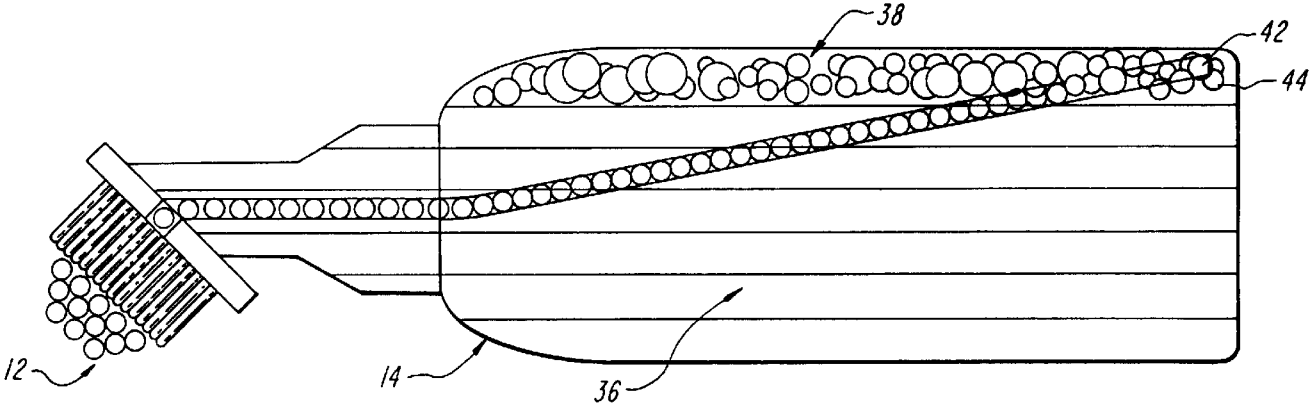
FIG. 3 is a longitudinal sectional view of the improved bottle brush of the present invention that illustrates the same in its first orientation when in its use and foam-dispensing mode.

In use and referring now to FIG. 3, the bottle 14 is seized by the hand and maintained and manipulated in a use orientation, preferably a generally-horizontal, first orientation, to impart a scrubbing action to the head 12. Since the region of foam 38 is always superadjacent to the region of liquid 36, the supply end 42 of the feed tube 16 opens at the point 44 into a region of foam in the use orientation. By squeezing the flexible walls of the squeeze bottle 14, the volume of the cavity 32 thereof is compressible, which forces a controlled amount of foam into the supply end 42 through the feed tube 16 out the feed end 40 thereof and into the applicator and scrubbing head 12. Because only foam is controllably dispensed in the use orientation, there is little, if any, wastage of liquid cleaning agent. Due to the larger volume of foam versus liquid, dispensation is easily gauged by the eye during use.

Figure 4:
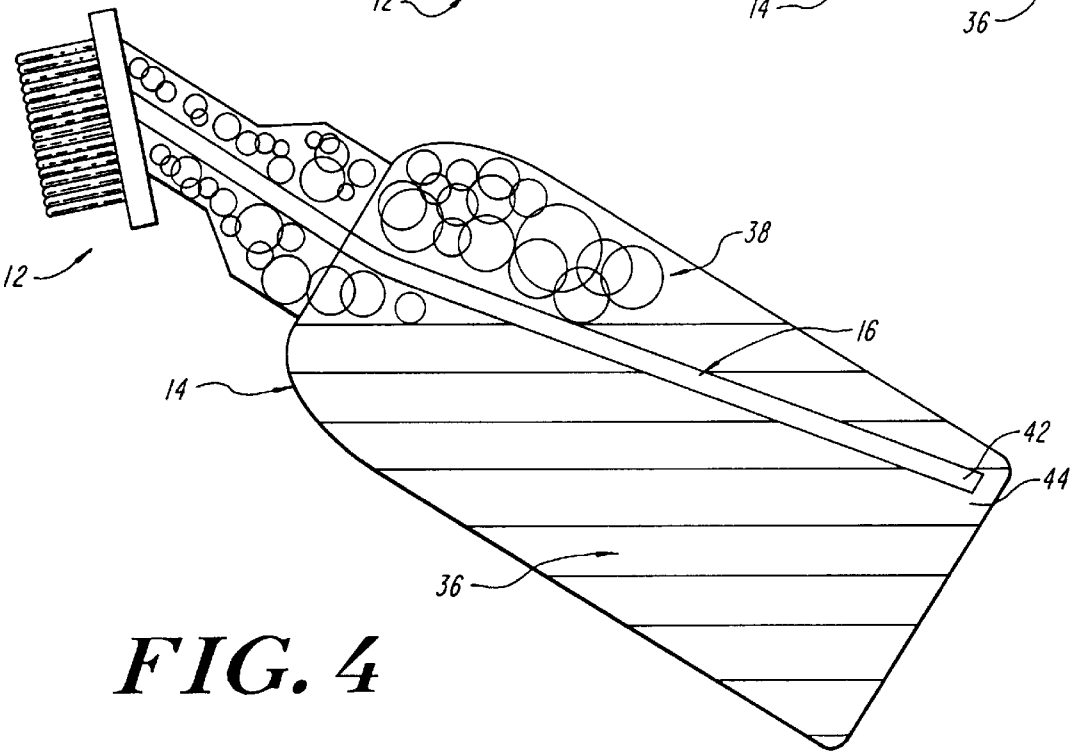
FIG. 4 is a longitudinal sectional view of the improved bottle brush of the present invention that illustrates the same in one second orientation when in its liquid dispensing mode.

In use and referring now to FIG. 4, the bottle 14 is seized by the hand and maintained in an orientation other than the use orientation, preferably a second orientation where the head 12 is upended relative to its position in the generally horizontal use orientation, to dispense a measure of liquid to the head 12. Since the region of foam 38 is always superadjacent the region of liquid 36, the supply end 42 of the feed tube 16 now opens at the point 44 into a region of liquid in the upended orientation. By squeezing the flexible walls of the squeeze bottle 14, the volume of the cavity 32 thereof is compressible, which forces a controlled amount of liquid into the supply end 42 through the feed tube 16 out the feed end 40 thereof and into the applicator and scrubbing head 12. Because only a controlled amount of liquid is dispensed in the second orientation, there is little, if any, wastage of liquid cleaning agent.

It will be appreciated that, although in the preferred embodiment the feed tube is bent to position its supply end at the point 44, any predetermined configuration of the feed tube determined in relation to the first and second orientations of the squeeze bottle such that its supply end opens into a region of foam in the use and foam-feed mode and opens into a region of liquid in the liquid-feed mode may be employed without departing from the inventive concepts.

Figure 5:
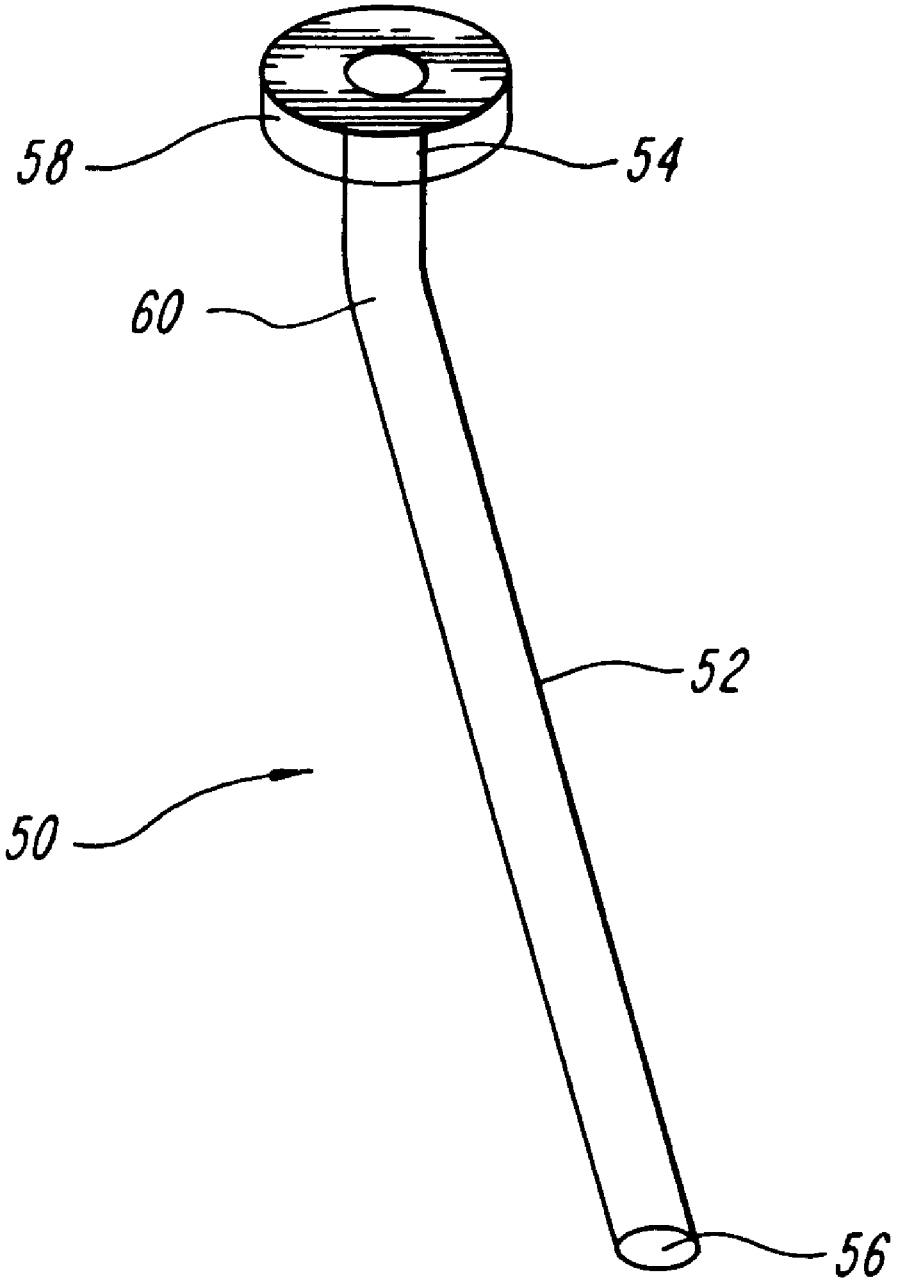
FIG. 5 is a perspective view of one embodiment of a conversion element for converting a conventional liquid-feed bottle brush into an improved bottle brush dispensing foam as well as liquid in accord with the present invention.

Referring now to FIG. 5, generally designated at 50 is a perspective view of a conversion element for converting a conventional, gravity-feed bottle brush into an improved bottle brush controllably feeding both foam and liquid in accord with the present invention. The conversion element 50 includes a feed tube 52 of predetermined configuration that has a feed end 54 and a supply end 56. A sealing member, such as a gasket 58, is disposed about the feed end 54 of the conversion element 50. It will be appreciated that other sealing members may be employed—in dependence on the specific type of bottle brush or other such dish cleaning instrument to be converted—without departing from the inventive concepts.

The feed tube 52 is mounted with the gasket 58 in sealing relation to the applicator head/squeeze bottle interface of a squeeze bottle to be converted of the type illustrated in the FIGS. 1–4, with its supply end opening into the internal cavity thereof. The feed tube is bent at 60 so that its supply end would be located at a point at and near both the base and body portions thereof. Although the feed tube is configured with the bend 60 in the illustrated embodiment, it will be appreciated that the predetermined configuration thereof is in each case determined in accord with the inventive principles in relation to the actual shape of the bottle brush to be converted or other such cleaning instrument such that its supply end would open to a region of foam, should the bottle brush to be converted be used in its corresponding use and foam feed mode, and such that it would open into a region of liquid, should it be used in its corresponding liquid feed mode.

Many modifications of the presently disclosed invention will become apparent to those of skill in the art without departing from the scope of the appended claims.

What is claimed is:

1. A selectably orientable liquid receivable device for use as a cleaner of dirty food preparation and serving wear that is capable of controllably dispensing liquid and foam cleaning agents selectably upon liquid receipt, comprising:

a hand-held dirty food preparation and serving wear cleaning instrument having a cleaning and scrubbing head adapted to clean dirty food preparation and serving wear;

said dirty food preparation and serving wear cleaning instrument having a first, foam feed and cleaning orientation and having a second liquid feed orientation generally and different from the first, generally horizontal, foam feed and cleaning orientation;

said dirty food preparation and serving wear cleaning instrument including means for providing a plenum having a predetermined volume that would partition itself into a first region where foam would be present and into a second region where liquid would be present should a dilute liquid cleaning agent of a lesser volume be disposed and agitated therein such that said region where foam would be present would always be superjacent said region where liquid would be present and said region where liquid would be present would always be subjacent said region where foam would be present in said plenum of said dirty food preparation and serving wear cleaning instrument at any selected orientation thereof; and said dirty food preparation and serving wear cleaning instrument including means coupled to said cleaning and scrubbing head adapted to clean dirty food preparation and serving wear and responsive to the orientation of the dirty food preparation and serving wear cleaning instrument for allowing foam to be dispensed to the cleaning and scrubbing head adapted to clean dirty food preparation and serving wear from the superjacent first region of said plenum of said instrument where foam would be present when the instrument is in its first, foam feed and cleaning orientation while preventing liquid to be dispensed to the cleaning and scrubbing head adapted to clean dirty food preparation and serving wear from the subjacent second region of said plenum of said instrument where liquid would be present, and for allowing liquid to be dispensed to the cleaning and scrubbing head adapted to clean dirty food preparation and serving wear from the subjacent second region of said plenum of said instrument where liquid would be present when the instrument is in its second liquid feed orientation generally and different from the first, foam feed and cleaning orientation while preventing foam to be dispensed to the cleaning and scrubbing head adapted to clean dirty food preparation and serving wear from the superjacent first region of said plenum of said instrument where foam would be present.

2. The invention of claim 1, wherein the instrument includes a squeeze bottle and wherein said providing means includes means for providing an internal cavity within the squeeze bottle whose volume is partitioned into said superjacent region of foam and said subjacent region of liquid when a said liquid cleaning agent is disposed therein to partially fill the same and the squeeze bottle shook to produce a foaming action in the liquid cleaning agent.

3. The invention of claim 2, wherein said foam and liquid allowing and preventing means includes a feed tube having a feed and a supply end, and wherein said feed tube is mounted in the squeeze bottle with its feed end in communication with the cleaning and scrubbing head and with its supply end extending into and opening in the internal cavity thereof.

4. The invention of claim 3, wherein the feed tube has a predetermined configuration determined in relation to the first and second orientations such that its supply end opens to the region plenum of foam when in its first orientation and opens to the region of liquid when in its second orientation.

5. The invention of claim 4, wherein the squeeze bottle is provided with a body of flexible walls and an included base that enclose said internal cavity, wherein the first orientation is a generally horizontal orientation, wherein the cleaning and scrubbing head adapted to clean dirty food preparation and serving ware is laterally inclined towards one side of the squeeze bottle, and wherein said predetermined configuration is determined such that the feed tube is so bent that its supply end opens at a point in the other side of the squeeze bottle at and near both the base and body thereof.

6. A selectably orientable liquid receivable device for use as a cleaner of dirty food preparation and serving wear that is capable of controllably dispensing liquid and foam cleaning agents selectably upon liquid receipt, comprising:

an elongated squeezable bottle having a neck portion terminating in an open mouth, a body portion of flexible walls dimensioned to be seized by a human hand and an included base portion, said neck, body and base portions enclosing an internal cavity whose volume is compressible whenever the flexible walls of said body portion are seized by the hand and squeezed thereby and whose volume is partitioned should it be filled with a liquid cleaning agent of a volume less than the volume of said cavity into a region where liquid would be present and into a region where there would not be any liquid but where there would be foam that is producible by shaking the elongated squeezable bottle, where the region where foam would be present always maintains a relation of superjacency to the region where liquid would be present independently of orientation of the elongated squeezable bottle;

an applicator and scrubbing head adapted to scrub dirty food preparation and serving wear having a feed orifice;

means for releasably mounting said applicator and scrubbing head to said elongated squeezable bottle with said feed orifice aligned to open into said open mouth of said elongated squeezable bottle; and said elongated squeezable bottle, and said applicator and scrubbing head adapted to scrub dirty food preparation and serving wear releasably mounted thereto, providing a hand-held dirty food preparation and serving wear cleaning instrument;

wherein said applicator and scrubbing head that is adapted to scrub dirty food preparation and serving wear is laterally inclined towards one side of said squeezable bottle;

said dirty food preparation and serving wear cleaning instrument having a first, generally horizontal, foam feed and cleaning orientation, and having a second liquid feed orientation generally upended to the horizontal and different from the first, generally horizontal, foam feed and cleaning orientation; and an applicator and scrubbing head feed tube having a supply end and a feed end that is mounted in said elongated squeezable bottle with its feed end in sealing relation with said feed orifice of said applicator and scrubbing head adapted to scrub dirty food preparation and serving wear and with its supply end extending into the interior cavity of said elongated squeezable bottle, said feed tube having a predetermined configuration determined in relation to said first, generally horizontal, foam feed and cleaning orientation and to the regions of said internal cavity where foam and liquid would be present such that its supply end opens at a point on the other side of said squeezable bottle to said region where foam would be present but not to said region where liquid would be present when said instrument is in its said first, generally horizontal, foam feed and cleaning orientation, enabling, when said elongated squeezable bottle is squeezed to compress the internal volume, any foam that may be present in said region of said internal cavity where foam would be present but not any liquid that may be present in said region of said internal cavity where liquid would be present to be forced into the supply end through the tube out the feed end thereof and through the feed orifice into the applicator and scrubbing head adapted to scrub dirty food preparation and serving wear, and further determined in relation to said second, liquid feed orientation generally upended to the horizontal and to the regions of said internal cavity where foam and liquid would be present such that the supply end opens to said region of said internal cavity where liquid would be present but not to said region of said internal cavity where foam would be present when said instrument is in its said liquid feed orientation generally upended to the horizontal, enabling, when said elongated squeezable bottle is squeezed to compress the internal volume, any liquid that may be present in said region of said internal cavity where liquid would be present but not any foam that may be present in said region of said internal cavity where foam would be present to be forced into the supply end through the tube out the feed end thereof and through the feed orifice into the applicator and scrubbing head adapted to scrub dirty food preparation and serving wear.

7. The invention of claim 6, wherein said applicator and scrubbing head includes a brush adapted to clean dirty food preparation and serving wear.

8. The invention of claim 6, wherein said predetermined configuration is determined such that the feed tube is bent to locate the supply end thereof at a point at and near both the base and the wall portions of the elongated squeezable bottle.

9. The invention of claim 6, wherein said applicator and scrubbing head is integrally formed with said neck, and wherein said releasably mounting means includes means for releasably mounting said neck to said body portion of said elongated squeezable bottle.

10. The invention of claim 6, wherein said releasably mounting means includes means for releasably mounting said applicator and scrubbing head to said neck.

11. A selectably orientable liquid receivable device for use as a cleaner of dirty food preparation and serving wear that is capable of controllably dispensing liquid and foam cleaning agents selectably upon liquid receipt, comprising:

an elongated squeezable bottle defining a longitudinal axis and having a neck portion terminating in an open mouth, a body portion of flexible walls dimensioned to be seized by a human hand and an included base portion, said neck, body and base portions enclosing an internal cavity whose volume is compressible whenever the flexible walls of said body portion are seized by the hand and squeezed thereby and whose volume is partitioned should it be filled with a dilute liquid cleaning agent of a volume less than the volume of said cavity into a region where liquid would be present and into a superjacent region where there would not be any liquid but where there would be foam that is producible by shaking the elongated squeezable bottle, where the region of said internal cavity where foam would be present always maintains a relation of superjacency to the region of said internal cavity where liquid would be present independently of orientation of the elongated squeezable bottle;

an applicator and scrubbing head having a feed orifice, a scrubbing element adapted to scrub dirty food preparation and serving wear and a scrubbing element support;

said applicator and scrubbing head defining a longitudinal axis and defining a normal extending from the scrubbing element support into the scrubbing element that makes an acute angle to the longitudinal axis of the applicator and scrubbing head adapted to scrub dirty food preparation and serving wear;

means for releasably mounting said applicator and scrubbing head to said elongated squeezable bottle with said feed orifice aligned to open into said open mouth of said elongated squeezable bottle and with said normal making an acute angle towards one side of the longitudinal axis of said elongated squeezable bottle;

said elongated squeezable bottle and said applicator and scrubbing head releasably mounted thereto providing a hand-held dirty food preparation and serving wear cleaning instrument;

said dirty food preparation and serving wear cleaning instrument having a first, generally horizontal, foam feed and cleaning orientation, and having a second liquid feed orientation generally upended to the horizontal and different from the first, generally horizontal, foam feed and cleaning orientation; and an applicator and scrubbing head feed tube having a supply end and a feed end that is mounted in said elongated squeezable bottle with its feed end in sealing relation with said feed orifice of said applicator and scrubbing head adapted to scrub dirty food preparation and serving wear and with its supply end opening into the interior cavity of said elongated squeezable bottle at a point to the other side of the squeezable bottle that is at and near to both the base and wall portions of the elongated squeezable bottle so that said supply end thereof opens to the region of said cavity where foam would be present, but not to the region of said cavity where liquid would be present, when said instrument is oriented in said first, generally horizontal, foam dispensing orientation and opens to the region of said cavity where liquid would be present, but not to the region of said cavity where foam would be present, when said instrument is oriented in said second, liquid dispensing orientation generally upended to the horizontal.

12. The invention of claim 11, wherein said applicator and scrubbing head includes a brush adapted to clean dirty food preparation and serving wear.

13. The invention of claim 11, wherein said applicator and scrubbing head is integrally formed with said neck, and wherein said releasably mounting means includes means for releasably mounting said neck to said body portion of said squeezable bottle.

14. The invention of claim 11, wherein said releasably mounting means includes means for releasably mounting said applicator and scrubbing head to said neck.

15. The invention of claim 11, further including a dilute liquid cleaning agent disposed in said internal cavity.

16. The invention of claim 6, further including a dilute liquid cleaning agent disposed in said internal cavity.

17. The invention of claim 1, further including a dilute liquid cleaning agent disposed in said plenum.

* * * * *